US006475017B1

(12) United States Patent
Wu

(10) Patent No.: US 6,475,017 B1
(45) Date of Patent: Nov. 5, 2002

(54) ELECTRICAL CONNECTOR WITH LATCH

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/006,414

(22) Filed: Nov. 30, 2001

(51) Int. Cl.[7] ..... H01R 13/62
(52) U.S. Cl. ..... 439/372
(58) Field of Search ..... 439/372

(56) References Cited

U.S. PATENT DOCUMENTS 5,924,886 A * 7/1999 Achammer et al. ..... 439/372
5,938,468 A * 8/1999 Lin ..... 439/372
6,273,743 B1 * 8/2001 Wakahara et al. ..... 439/372

* cited by examiner

*Primary Examiner*—Gary R Paumen
(74) *Attorney, Agent, or Firm*—Wei Te Chung

(57) ABSTRACT

An electrical connector (10) includes an insulative housing (12), a number of electrical terminals (27) received in the insulative housing, and a pair of latches (14). The insulative housing has a pair of longitudinally spaced opposite end portions (12*a*) and a base (16). The latches are pivotally assembled to the base of the insulative housing and are engageable with tabs (162) and barbs (163) of the base to selectively locate the electrical connector between an open position and a fixed position.

1 Claim, 6 Drawing Sheets

ELECTRICAL CONNECTOR WITH LATCH

BACKGROUND OF THE INVENTION

1. Field of the Invention

The present invention generally relates to the art of electrical connectors and, more particularly, to a latch structure for latching an electrical connector to a complementary mating component.

2. Description of the Related Art

A pair of electrical connectors, such as male and female or plug and receptacle connectors, are often secured together in a mated condition by a latch structure of certain form. One type of the latch structure is a bail-type latch. A bail latch is a generally U-shaped wire formed somewhat like an elongated 180 degrees loop as defined by a pair of spaced leg portions with upper ends joined by a bight portion and lower ends pivotally mounted to the base of an insulative housing of an electrical connector.

The lower ends of the leg portions of each bail latch are respectively inserted through opposite sides of the insulative housing to be retained to a bottom of the insulative housing. Structures formed on the bottom of the insulative housing to correspond to the lower ends are usually somewhat complicated due to the wire structure of the bail latches. Furthermore, the latches are always in the danger of inadvertent damage and falling off from the insulative housing during shipping of the electrical connector because of the non-restrictive movability thereof with respect to the insulative housing of the electrical connector.

Therefore, an improved electrical connector is desired to overcome the disadvantages of the prior art.

SUMMARY OF THE INVENTION

A major object of the present invention is to provide an electrical connector having a structurally simplified latch for latching to a complementary mating component.

Another object of the present invention is to provide an electrical connector having a latch, inadvertent damages and falling off of which are reduced or eliminated.

An electrical connector in accordance with the present invention comprises an insulative housing, a plurality of electrical terminals and a pair of latches for latching to a complementary mating component. The insulative housing comprises a base, a pair of laterally spaced upstanding opposite sides, and a pair of longitudinally spaced opposite end portions. The latches are pivotally assembled to the insulative housing and are restricted by the insulative housing to move between an open position and a fixed position.

Other objects, advantages and novel features of the invention will become more apparent from the following detailed description of the present embodiment when taken in conjunction with the accompanying drawings.

DETAILED DESCRIPTION OF THE INVENTION

Figure 1:
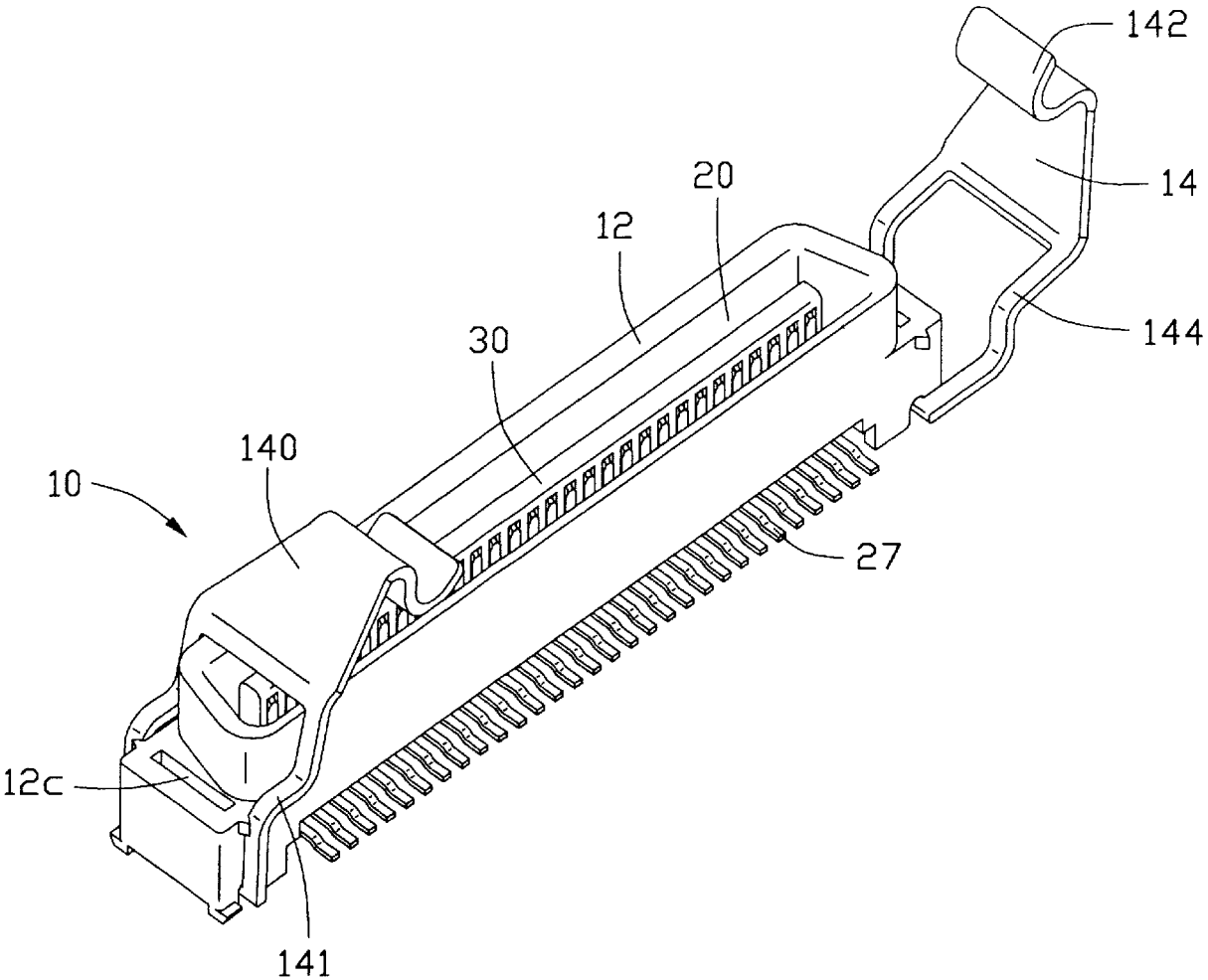
FIG. 1 is a perspective view of an electrical connector in accordance with the present invention.

Referring to FIG. 1, an electrical connector 10 in accordance with the present invention comprises an insulative housing 12, a plurality of electrical terminals 27, and a pair of latches 14.

Figure 2:
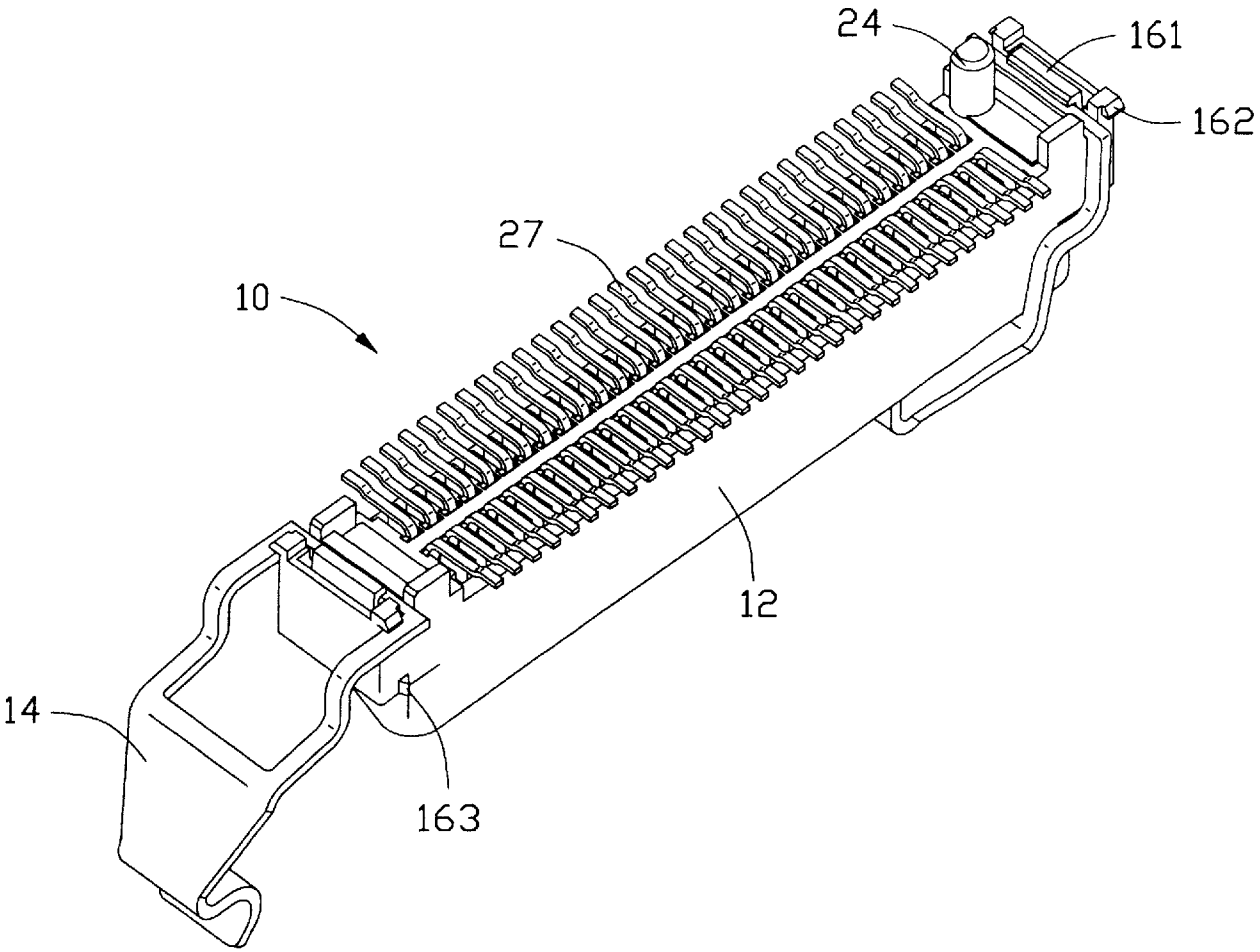
FIG. 2 is an inverted perspective view of the electrical connector of FIG. 1.
Figure 3:
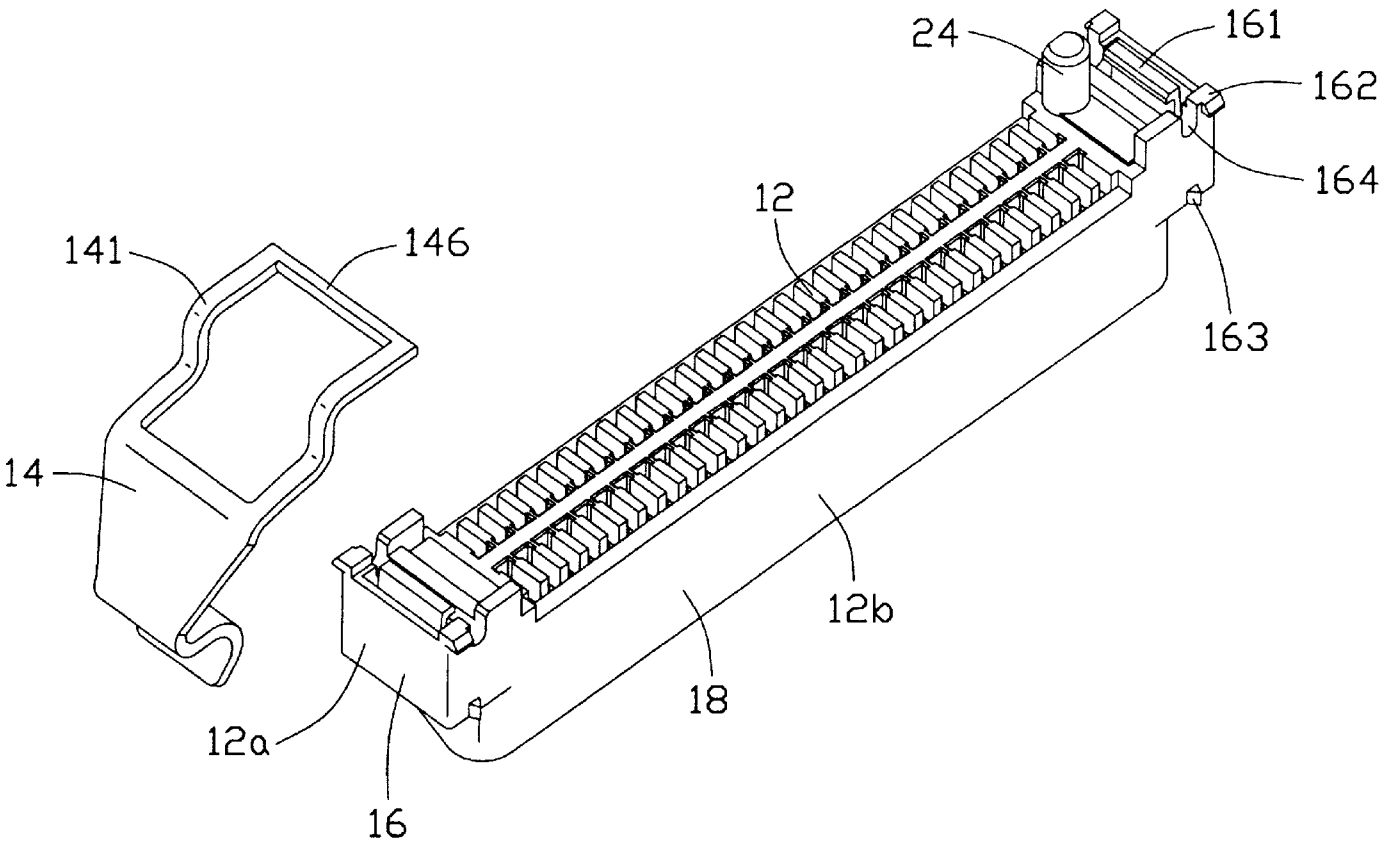
FIG. 3 is an exploded and inverted view of an insulative housing and a latch of the electrical connector of FIG. 1.
Figure 6:
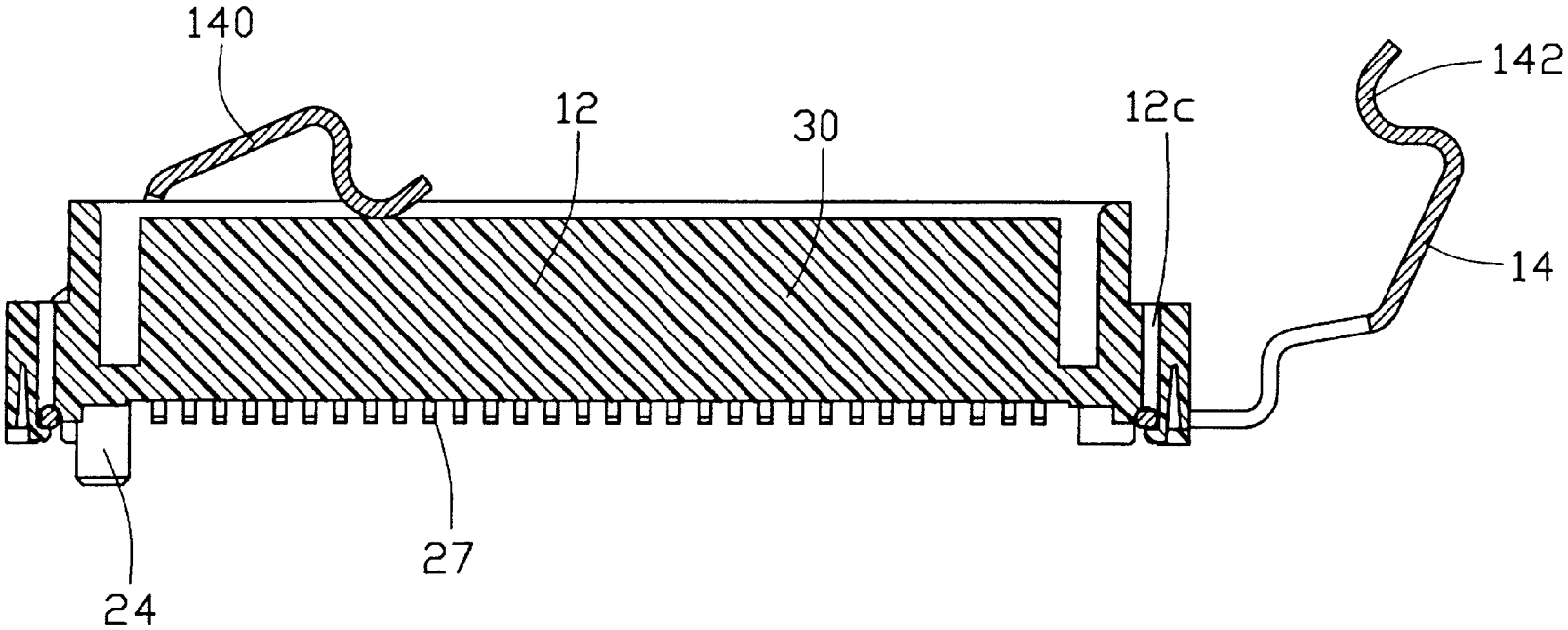
FIG. 6 is a cross-sectional view taken along line 6—6 of FIG. 4.

Referring also to FIGS. 2, 3 and 6, the insulative housing 12 is a one-piece structure unitarily molded of dielectric material such as plastic or the like. The insulative housing 12 is elongated and includes longitudinally-spaced opposite end portions 12*a* and laterally-spaced opposite sides 12*b*. More particularly, the insulative housing 12 has a base 16 and an upstanding mating portion 18. The mating portion 18 is of a known D-shaped configuration and defines a D-shaped receptacle 20 for receiving a similarly shaped mating plug portion of a complementary mating connector. A tongue portion 30 projects into the receptacle 20. The electrical connector 10 is designed for mounting on a printed circuit board (not shown) with the base 16 of the electrical connector 10 mounted on a top surface of the printed circuit board. One or more polarizing posts 24 depend from the insulative housing 12 for insertion into appropriate mounting holes in the printed circuit board. Each end portion 12*a* defines a slit 12*c* extending vertically therethrough. The base 16 has a pair of laterally extending slots 164 recessed from a bottom face thereof and being located under the opposite end portions 12*a*, respectively, an L-shaped projection 161 protruding downwardly from the bottom face and extending downwardly beneath each slot 164, a pair of opposite tabs 162 extending outwardly from a bottom of each end portion 12*a* and a pair of opposite barbs 163 protruding outwardly from an upper section of each end portion 12*a*.

Figure 4:
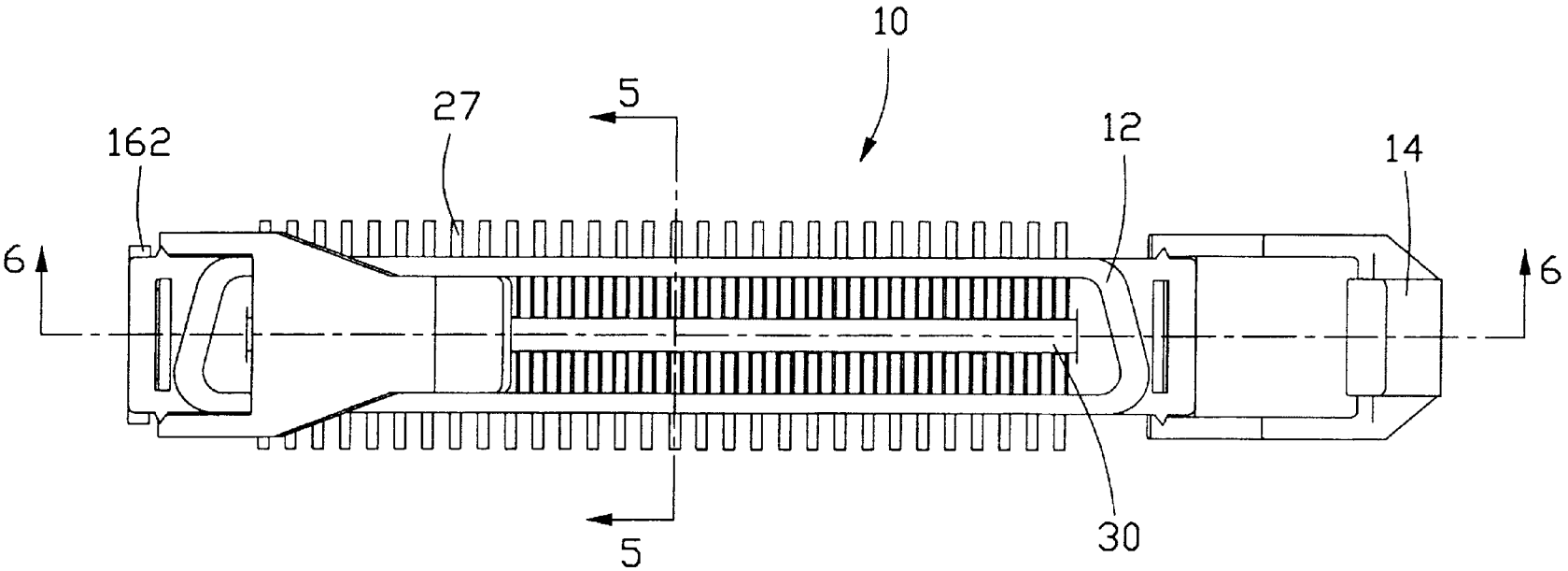
FIG. 4 is a top planar view of the electrical connector of FIG. 1.
Figure 5:
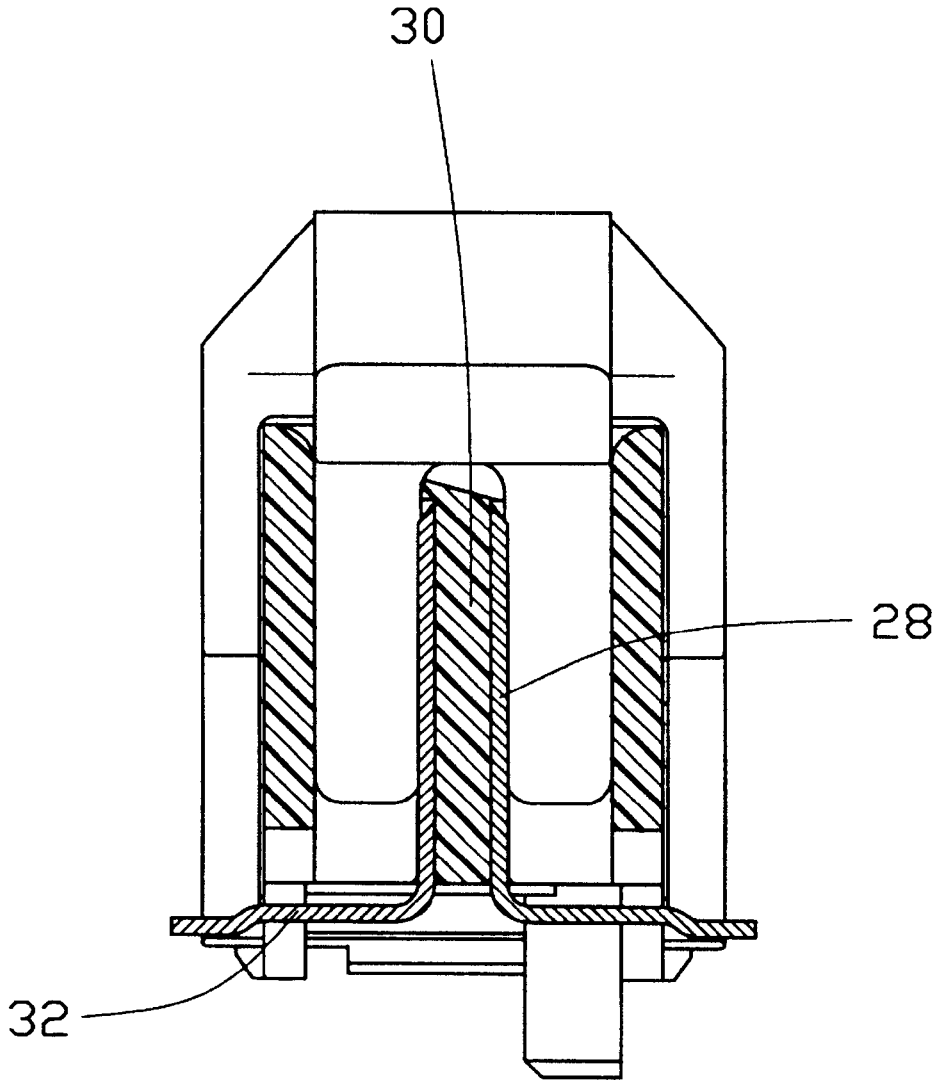
FIG. 5 is a cross-sectional view taken along line 5—5 of FIG. 4.

Referring also to FIGS. 4 and 5, the electrical terminals 27 are arranged in two rows lengthwise of the insulative housing 12. Each electrical terminal 27 has a contact portion 28 on either side of the tongue portion 30 of the insulative housing 12 and a tail portion 32 generally flush with the bottom of the base 16 of the insulative housing 12. The contact portions 28 are adapted for engaging appropriate terminals of a mating connector (not shown), and the tail portions 32 are adapted for surface connection, as by soldering, to circuit traces on the top surface of the printed circuit board.

Each latch 14 is stamped from a metal sheet and comprises an inwardly curved latching portion 142 for latching to a complementary mating component (not shown), a hollow-frame shaped assembling portion 144 and a transitional portion 140 therebetween. Each transitional portion 140 is a generally trapezoid-shaped plate with a width of an upper section thereof being less than a width of a lower section thereof. The transitional portions 140 are so configured as to reinforce the latches 14. The latching portion 142 extends upwardly from the upper section of the transitional portion 140 and is generally rectangular shaped before being curved. The assembling portion 144 comprises a pair of spaced leg sections 141 extending downwardly from opposite sides of the lower section of the transitional portion 140 and a pivotal section 146 connecting the leg sections 141. The leg sections 141 are generally Z-shaped. The leg sections 141 and the pivotal section 146 define an opening therebetween.

In assembly, the pivotal sections 146 of the latches 14 are received in the slots 164 and are restrained from downwardly moving and falling off from the insulative housing 12 by the projections 161.

During shipping of the electrical connector 10, the latches 14 are pivotally moved inwardly about the pivotal sections 146 with respect to the insulative housing 12 to force the leg sections 141 through the barbs 163. In such a way, the electrical connector 10 is located in a fixed position and the assembling portions 144 of the latches 14, as exemplified by the latch 14 in a left side of FIG. 1 and/or in a right side of FIG. 2, are retrained from lateral movements by opposite side surfaces of the opposite end portions 12*a* of the insulative housing 12 and are retrained from outward movement by the barbs 163, thereby reducing inadvertent damages of the latches 14.

When the electrical connector 10 is intended to receive a complementary mating component, the latches 14 are forced to pivotally move outwardly through barbs 163 until the leg sections 141 engage with the tabs 162 to, as exemplified by the latch 14 in a right side of FIG. 1 and/or in a left side of FIG. 2, locate the electrical connector 10 at an open position.

The pivotal sections 146 of the latches 14 are pivotally retained in the uninterrupted slots 164 only by the projections 161 of the insulative housing 12 therebelow, so structures of the insulative housing 12 are simplified. Furthermore, the latches 14 are restricted between the open and the fixed positions by the tabs 162 and the barbs 163, respectively, so inadvertent damages thereof and falling off thereof from the insulative housing 12 are eliminated or reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base, longitudinally spaced apart opposite end portions and laterally spaced apart upstanding opposite sides;

a plurality of electrical terminals mounted in the insulative housing; and a pair of latches each comprising a latching portion adapted for latching to a complementary mating component, an assembling portion and a transitional portion therebetween, the assembling portions being pivotally assembled to the base of the insulative housing and being engageable with the base to locate the electrical connector at a fixed position and an open position, respectively, wherein each of the end portions of the insulative housing defines a slot recessed from a bottom face of the base, and the assembling portions of the latches each have a pivotal section received in the slot of the end portion;

wherein the insulative housing comprises a projection extending downwardly beneath each slot to retain the pivotal section in the slot;

wherein the slot extends uninterruptedly through the housing and the pivotal section extends through the slot uninterruptedly;

wherein the assembling portion comprises a pair of spaced leg sections extending from opposite sides of a lower section of each transitional portion and connected by the pivotal section, the leg sections of each assembling portion overlying opposite sides of the end portion of the insulative housing;

wherein the base comprises a pair of barbs to engage with the leg sections to locate the electrical connector at the fixed position;

wherein the base comprises a pair of tabs to engage with the leg sections to locate the electrical connector at the open positions;

wherein each transitional portion is a trapezoid-shaped plate, and the latching portion extends upwardly from an upper section of the transitional portion and is generally inwardly curved;

wherein each latch is stamped from a metal sheet and the transitional portion is formed between the latching portion and the assembling portion so as to reinforce the latch.

* * * * *